United States Patent [19]

Falkingham

[11] Patent Number: 4,629,839

[45] Date of Patent: Dec. 16, 1986

[54] HIGH CURRENT SWITCH CONTACTS

[76] Inventor: Leslie T. Falkingham, 25 Lullington Garth, Borehamwood, Hertfordshire, United Kingdom

[21] Appl. No.: 636,904

[22] Filed: Aug. 2, 1984

[30] Foreign Application Priority Data

Aug. 9, 1983 [GB] United Kingdom ..... 8321368

[51] Int. Cl.[4] ..... H01H 33/66

[52] U.S. Cl. ..... 200/144 B

[58] Field of Search ..... 200/144 B

[56] References Cited

U.S. PATENT DOCUMENTS

| | | | |
|---|---|---|---|
| 3,372,258 | 3/1968 | Porter | 200/144 B |
| 3,818,164 | 6/1974 | Mizutani et al. | 200/144 B |
| 3,845,262 | 10/1974 | Hundstad | 200/144 B |
| 4,117,288 | 9/1978 | Gorman et al. | 200/144 B |
| 4,210,790 | 7/1980 | Kurosawa et al. | 200/144 B |
| 4,438,307 | 3/1984 | Lippmann et al. | 200/144 B |

*Primary Examiner*—Robert S. Macon

*Attorney, Agent, or Firm*—Kirschstein, Kirschstein, Ottinger & Israel

[57] ABSTRACT

A contact head (9) for a vacuum interrupter switch is cup-shaped and has a plurality of slots (6) formed therein, each slot passing through the wall-part (5) of the contact head in a generally helical direction and extending partly through the base portion (4) in a chordal direction.

11 Claims, 4 Drawing Figures

HIGH CURRENT SWITCH CONTACTS

This invention relates to contacts of electrical switch devices for use in circuits designed to carry high currents and especially to contacts of vacuum interrupters as well as other forms of vacuum switches, including so-called "vacuum contactors".

In a vacuum interrupter the electric current normally flows in series through two abutting contacts located in an envelope which is evacuated to an internal pressure, typically less than $10^{-4}$ mm. Hg. The two contacts are arranged to be moved apart to interrupt the flow of current and this causes one or more arcs to be drawn between the two contacts through which current will continue to flow until the arcs are extinguished.

If a magnetic field is provided which extends in a direction perpendicular to the direction of the current flowing in the arcs, the arcs will tend to move in a third direction perpendicular to these two directions. Such movement of the arcs is advantageous in that it prevents local overheating of the contact surfaces and consequent production of high vapour pressures which can lead to reignition of an arc.

Various contacts have been designed which provide this magnetic field, and they generally fall into two distinct types.

One type, e.g. as disclosed in U.K. Pat. Nos. 997384, 1087792 and 1100259, consists of a contact with an annular ridge providing the contact surface, the ridge having a number of radial slots in it which are inclined to the longitudinal axis of the ridge so as to produce a plurality of contact elements. The slots of each of the two contacts in an interrupter are inclined in the opposite direction so that the magnetic field induced by the current arcing from one contact element to the respective element of the other contact is asymmetrical and consequently moves the arc from one set of contact elements to the next around the annular ridge finally producing a diffuse annular arc after one complete revolution. However, when the two contacts are first separated, the arc that is formed is initially stationary, there being a short delay before the magnetic field has built up enough force to move the arc around the contact elements, and this can produce some damage to the contact elements on which its was first situated.

The second conventional type of contact, e.g. as disclosed in U.K. Pat. Nos. 922012 and 1219805, generally consists of a disc shaped conducting contact member having a series of slots extending from the outer periphery of the discs radially inwards by generally spiral paths. This forces the current flowing to or from an arc terminal located on the peripheral region of the disc to follow a path having a net tangential component which again tends to drive the arc in a circumferential direction about the contacts. Although such a contact configuration results in an initially more rapid movement of the arc, the arc does not become diffuse but remains constricted, thus causing some considerable wear of the parts of the spiral arms of the contact over which it passes, which can result in a rapid failure of devices utilising contacts of this form.

It is an object of the present invention to provide an improved contact which will tend to overcome the disadvantages of the conventional contacts described above, be cheaper to manufacture, have a longer lifetime and have a higher current interruption capability.

Therefore, according to one aspect of the invention, there is provided a contact for high current electrical switch devices comprising a generally cup-shaped electrically conducting member having a base portion and an annular portion upstanding from said base, the member having a plurality of slots formed therein, each slot passing through at least the part of the upstanding portion adjacent the base in a generally helical direction and, from its junction with the base, continuing partly across the base in a chordal direction.

According to a second aspect of the invention there is provided an electrical switch device comprising a pair of relatively movable cup-shaped contacts arranged to provide a current path through their rims when they are in contact and to interrupt said current path when they are not in contact, the contacts having a plurality of inclined slots in their sides, which slots extend into their bases, dividing the contacts into a plurality of segments which are so shaped that when in use a current passes between the contacts the current path in each segment has a tangential component in both the base and the rim of the contact such that on separation of the contacts the magnetic field produced by the current passing through the segments causes the arc that is formed between the contacts to be imemdiately forced to rotate around the rims of the contacts.

The optimum number of slots provided in a contact is between three and eight and it is preferred that there be four. The slots are preferably straight and may pass right through the rim of the contact. The contact is preferably made of a copper alloy.

In a preferred embodiment there is provided a ring of conducting material having a low weld strength on top of the rim of the contact to provide the actual touching part of the contact. The ring may or may not also be slotted, and is preferably made of a sintered matrix of chromium infiltrated with a proportion of copper, but any suitable contact material may be used.

The electric switch device is preferably either a vacuum interrupter or a vacuum contractor such as are well known in the art.

A contact in accordance with the invention may be easily fabricated, as the slots can be formed by making straight cuts inwards from the outer surface of the upstanding portion of the contacts, at an appropriate angle to the contact axis.

However the slots need not necessarily be straight, and although the base and upstanding portions are preferably integral with one another they could be made from separate preshaped elements subsequently secured together.

One embodiment of the invention will now be further described with reference to the drawings in which.

Figure 1:
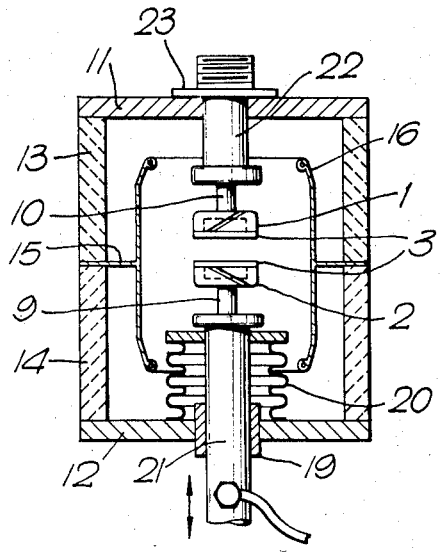
FIG. 1 shows a vacuum interrupter device incorporating contacts according to the invention.

A vacuum interrupter device such as that shown in FIG. 1 consists of a pair of end plates 11, 12 bonded in a vacuum-tight manner respectively to cylinders 13, 14 of insulating material. The cylinders 13, 14 are bonded to a flange 15 which is trapped between them, and carries a shield 16 of generally cylindrical form.

The vacuum interrupter is provided with a pair of relatively separable contacts 1, 2, the movable contact 2 being capable of movement by means of an actuator (not shown) towards and away from the fixed contact 1.

The movable contact 2 has its contact stem 21 reciprocable in a bushing 19, and a flexible conductor is provided which is attached to the contact stem 21. A bellows device 20 is secured in a vacuum-tight manner to the contact stem 21 and to the base plate 12 to allow movement of the contact 2. The fixed contact 1 also incorporates a contact stem 22 which extends through the respective end plate 11 and carries a flange 23 which is sealed in a vacuum-tight manner to the end plate.

Figure 2:
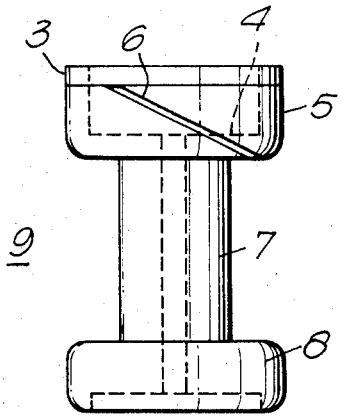
FIG. 2 shows an elevational view of one contact.
Figure 3:
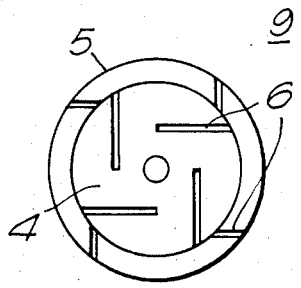
FIGS. 3 and 4 show a plan view and a part perspective view of a part of the contact shown in FIG. 2.
Figure 4:
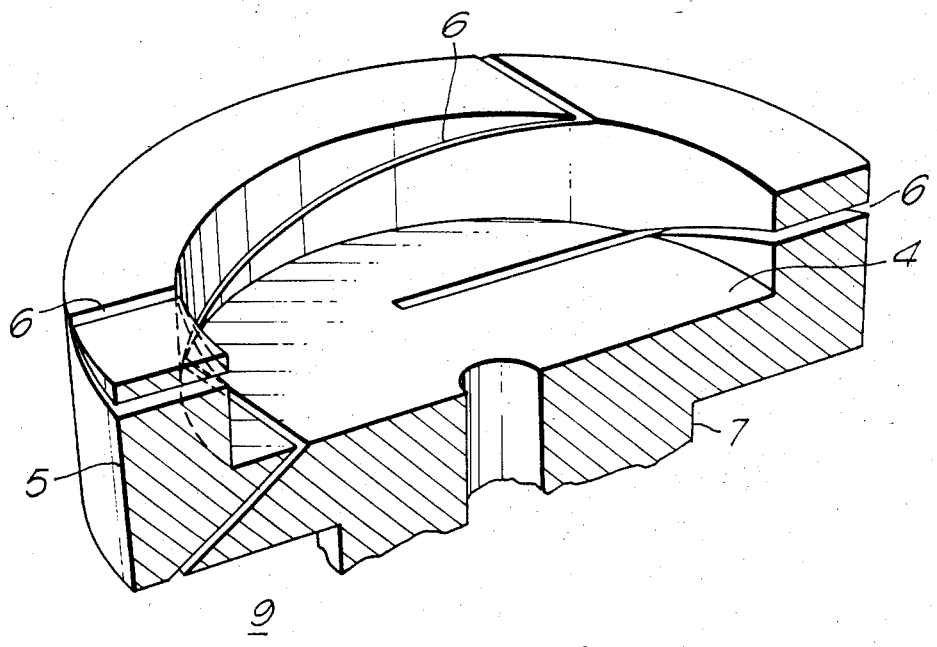

The contact stems 21, 22 have respective contact heads 9, 10 secured to them; these contact heads are of a generally similar construction, and the contact head 9 will be described in more detail with reference to FIGS. 2 to 4.

The contact head 9 is conveniently formed in one piece and consists of a cylindrical central region 7 having, at one end, a flange 8 for connection to the contact stem 21, and, at the other end, a cup-shaped contact consisting of a base 4 having an annular rim 5 upstanding from it. The cup shaped contact has four slots 6 cut at an angle to the axis of the cup passing through both the rim 5 and the base 4. Each slot 6 is cut in only half of the cup-shaped member and the slots are spaced 90° apart in rotation so as to divide the cupshaped member into four segments, each segment being of a generally-helical shape, the distance between the inner end of each slot 6 and the annular rim 5, measured along the slot, being greater than the distance between the inner end of the slot and the annular rim portion in a direction at right angles to the slot as shown more clearly in FIGS. 3 and 4.

The contact head 9 is preferably made of CCS copper alloy since this is easy to work and not too expensive. However the actual touching parts of the contacts need to be made of a low weld-strength metal and for this purpose a ring 3 formed of a sintered matrix of chromium infiltrated with a proportion of copper, as described for example in Patent Specification No. 1194674 is brazed onto the top of the rim of the contact head, the ring being omitted from FIGS. 3 and 4. The ring may, but need not, be slotted. This is a further advantage of the present invention since the previously described disc-shaped contacts needed to be made fully of the expensive low weld-strength alloy whereas in the present case only the ring need be made of it and the rest of the contact can be made of a cheap copper alloy.

It will be appreciated that this arrangement can be described either as being a discshaped contact having spiral cuts, as described above, with the outer ends of the segments being folded up into the third dimension, or as being a cup-shaped contact having inclined slots in the sides extended into the base.

The arrangement of slots in the base of the cup-shaped contact as above in accordance with the invention forms a current path having an appreciable circumferential component which provides an extra driving force on the arc which is formed as the contacts are moved apart, and consequently results in an immediate movement of the arc; in addition, the slotted sides of the contact gives rise to the production of a diffuse annular arc. We have found that with such a contact construction damage of the contact does not take place to the same extent as in the known forms of contacts referred to above. Consequently, contacts according to the invention can be made smaller than at present, for the same current carrying capacity and have a longer lifetime. As previously explained the contact head 10 is constructed in a similar manner to the head 9 although it is a mirror image of the latter so as to produce the required arc movement.

I claim:

1. A contact for high current electrical switch devices consisting of a generally cup-shaped electrically conducting member having an axis of symmetry, a base, means for electrically connecting the contact to a support conductor on one side of the base, and an annular rim portion surrounding the symmetry axis and upstanding from the opposite side of the base: wherein the improvement comprises, the member having a plurality of substantially straight slots so formed therein as to cause an arc formed upon separation of the member with another like member to be immediately and rapidly rotated circumferentially about the symmetry axis, each slot passing through at least part of the annular upstanding rim portion adjacent the base in a generally helical direction and, from its junction with the base, continuing partly across the base in a chordal direction and in an orientation such that, at said opposite side of the base, the distance between the inner end of the slot and the annular rim portion measured along the slot, is greater than the distance between the inner end of the slot and the annular rim portion in a direction at right angles thereto.

2. A contact according to claim 1 wherein there are between three and eight slots provided in the contact.

3. A contact according to claim 2 wherein there are four slots provided in the contact.

4. A contact according to claim 1 wherein the slots pass through the rim of the upstanding portion of the contact.

5. A contact according to claim 1 which is made of a copper alloy.

6. A contact according to claim 1 wherein there is further provided a ring of conducting material having a low weld strength on top of the rim of the upstanding portion of the contact to provide the actual touching part of the contact.

7. A contact according to claim 6 wherein said ring of conducting material is made of a sintered matrix of chromium infiltrated with a proportion of copper.

8. A contact according to claim 1 wherein the base and upstanding portion are made integral with one another.

9. An electrical switch device consisting of a pair of relatively movable cup-shaped contacts each having an axis of symmetry, a base, means for electrically connecting the contact to a support conductor on one side of the base, and an annular side portion surrounding the symmetry axis and upstanding from the opposite side of the base, the contacts being supported with the annular side portions directed coaxially towards each other, the rims of the annular side portions being engageable to provide a current path between the contacts, and separable to interrupt the current path: wherein the improvement comprises, each of said contacts having a plurality of substantially straight slots so formed therein as to cause an arc formed on separation of the contacts to be immediately and rapidly rotated circumferentially about the symmetry axis and around the rims, each slot passing through at least part of the annular upstanding side portion in a direction inclined to the symmetry axis, and continuing partly across the base in a generally chordal direction and at a position such as to provide a plurality of segments each of which defines a current path having a tangential component in both the base and the side portions, whereby on separation of the contacts the magnetic field produced by the current passing through the segments causes the arc that is formed between the contacts to be immediatley forced to rotate around the rims of the contacts.

10. An electrical switch device according to claim 9 which is a vacuum interrupter.

11. An electrical switch device according to claim 9 which is a vacuum contactor.

* * * * *